US006026910A

United States Patent [19]

Masterson et al.

[11] Patent Number: 6,026,910

[45] Date of Patent: Feb. 22, 2000

[54] POWER TOOL AND VIBRATION ISOLATOR THEREFOR

[75] Inventors: Peter A. Masterson, Rock Hill, S.C.; William K. Wallace, Barneveld, N.Y.; Ulrich A. Kuester, Erie, Pa.

[73] Assignees: Chicago Pneumatic Tool Company, Rock Hill, S.C.; Lord Corporation, Cary, N.C.

[21] Appl. No.: 09/006,098

[22] Filed: Jan. 13, 1998

[51] Int. Cl.[7] ..... B27B 17/00

[52] U.S. Cl. ..... 173/162.2; 173/169; 267/141.1; 267/153

[58] Field of Search ..... 173/162.1, 162.2, 173/210, 169, 170, 211; 267/141.1, 141, 153, 137

[56] References Cited

U.S. PATENT DOCUMENTS

| | | | |
|---|---|---|---|
| 1,592,130 | 7/1926 | Wadsworth . | |
| 2,058,583 | 10/1936 | Forss . | |
| 3,003,738 | 10/1961 | Horovitz | 267/141.1 |
| 3,477,674 | 11/1969 | Schaller | 267/153 |
| 3,571,874 | 3/1971 | Von Arx . | |
| 3,652,074 | 3/1972 | Frederickson et al. | 173/162.1 |
| 3,700,015 | 10/1972 | Kobayashi et al. | 267/137 |
| 3,845,827 | 11/1974 | Schulin | 173/162.1 |
| 3,968,843 | 7/1976 | Shotwell . | |
| 4,135,301 | 1/1979 | Hoeppner | 267/137 |
| 4,522,270 | 6/1985 | Kishi . | |
| 4,995,598 | 2/1991 | Ingham | 267/141.1 |
| 5,054,414 | 10/1991 | Yamaguchi . | |
| 5,368,107 | 11/1994 | Taomo . | |
| 5,447,295 | 9/1995 | Taomo . | |
| 5,453,577 | 9/1995 | Everett et al. . | |
| 5,551,661 | 9/1996 | Bunker | 267/153 |

FOREIGN PATENT DOCUMENTS

| | | |
|---|---|---|
| 0 164 324 | 12/1985 | European Pat. Off. . |
| 716805 | of 1980 | Russian Federation . |
| WO 94/16864 | of 1994 | WIPO . |
| WO 97 25186 | 7/1997 | WIPO . |

*Primary Examiner*—Scott A. Smith
*Attorney, Agent, or Firm*—Schmeiser, Olsen & Watts

[57] ABSTRACT

The present invention relates to a power tool having a housing, a handle having an inlet passage and an outlet passage extending therethrough, and a pneumatic pressure seal/vibration isolator positioned between the handle. The present invention provides a tool that has an excellent handle to housing seal and does not exhibit heavy vibrations. The present invention is also the vibration isolator that seals the handle to the motor housing and reduces vibrational transmissions to a user. Also disclosed is a power tool having a vibration isolator coupled to the housing and handle, and a mechanism for allowing sliding rotation of the handle relative to the vibration isolator, thereby allowing the handle to point in a different direction other than toward the point of impact. The present invention also discloses a pneumatic power tool including a handle, a housing having a first longitudinal axis, and a vibration isolator rotatably coupling the handle to the housing, the vibration isolator including a central opening through which air passes that is not aligned with the first longitudinal axis.

12 Claims, 3 Drawing Sheets

POWER TOOL AND VIBRATION ISOLATOR THEREFOR

FIELD OF THE INVENTION

The present invention relates generally to hand-held power tools. In particular, the present invention is concerned with power tools with a vibration isolator. Further, the present invention relates to the vibrator isolator.

BACKGROUND OF THE INVENTION

A recurring difficulty with hand-held power tools is a lack of an easily mounted vibrational isolator between the tool motor housing and the tool handle. Vibrations being transmitted to a tool handle can cause discomfort to certain user's. Another hurdle in the related art is pneumatically sealing the power tool handle to the motor housing where the handle delivers compressed air and exhausts expanded air to and from the motor housing. Yet another difficulty arises in arriving at tool handles that provide a convenient and comfortable hand/wrist position for a user.

Manufacturers and developers have created a number of vibration isolators to prevent vibration transmission to a user. For example, U.S. Pat. No. 2,058,583 to Forss, illustrates a vibration isolator 16 for isolating the handle 9 from the motor housing 1. U.S. Pat. No. 3,968,843 to Shotwell also provides a vibration isolator 30, 32, 34. Further, WO 94/16864 to Gwinn discloses a vibration isolator 10 enclosed within a power tool housing. The vibration isolators discussed above require elaborate handle to housing fastener setups that prevent the provision of adjustable handles and are limited to isolators being in alignment with the housing.

With regard to sealing the handle to the housing, separate sealing structures are oftentimes required altogether. For instance, in U.S. Pat. No. 3,968,843 to Shotwell, a liner 40 separate from the isolator 30 is used to provide a sealed passage. The additional structure adds weight and complexity to the power tool. The related art also fails to sufficiently address the sealing of a handle where the handle both delivers and exhausts air to and from the motor housing.

With regard to adjustable handles, the related art has utilized straight, side, angled or spade handles in order to achieve a correct hand/wrist position. The difficulty with this concept is that the operator has to do a variety of different jobs with the same tool. Thus, a straight handled tool may be ideal for one application but not ideal on another application where a turned or angled handle is better suited.

In an attempt to overcome this limitation, power tool developers and manufacturers have introduced adjustable type handles for their power tools and varied vibration isolators. For example, U.S. Pat. No. 4,522,270 issued to Kishi discloses a hand-held power tool which provides a handle that pivots angularly with respect to the tool housing. Similarly, U.S. Pat. No. 3,571,874 issued to Von Arx discloses a descaling device which also has a handle that pivots angularly with respect to the tool housing. These inventions allow the tool handle to be angularly pivoted toward or away from the tool attachment/impact point. This gives the operator an increased ability to find a more comfortable or efficient handle position which he or she lacked in the past.

While the aforementioned patents provide a certain amount of improvement with regard to handle comfort, there are still difficulties which these devices do not address. For instance, given that most tools have a trigger on the handle, these devices do not have the ability to change the direction of the trigger with respect to the tool housing. In other words, the trigger always faces in the same direction—towards the tool attachment/impact point. Under certain circumstances, in order to achieve the ideal hand/wrist position, an operator may want to have the trigger facing a direction other than that of the direction of the tool. Further, the rotatable handle tools heretofore used do not provide sufficient vibration isolation between the motor housing and handle and, further, do not address the sealing of the handle to the motor housing where such sealing is necessary.

Accordingly, until now, there has been a long-felt need for a power tool having a structure that vibrationally isolates and seals a handle to a motor housing in a single, easily mounted structure where the handle delivers/exhausts air to the housing. Further, there has been a long-felt need for a structure that addresses the above noted problems and also allows for adjustment of the handle relative to the motor housing. The present invention seeks to provide this functionality.

SUMMARY OF THE INVENTION

In a first general aspect in accordance with the present invention is provided a power tool including a housing, a handle, rotatably attached to the housing, having an inlet passage and an outlet passage extending therethrough, and a pneumatic pressure seal/vibration isolator between the motor and handle. The pneumatic pressure seal/vibration isolator includes a first rigid member operatively coupled to the housing, a second rigid member operatively coupled to the handle, and an elastomeric element extending between the first rigid member and the second rigid member. This aspect allows pneumatic pressure to pass through the handle yet provides for excellent vibration isolation.

In a second aspect in accordance with the present invention is provided a vibration isolator having a first member operatively coupled to the motor housing, a second member operatively coupled to the handle, and an elastomeric member extending between the first member and second member. The second member also includes a first portion operatively coupled to the elastomeric member and a second portion extending toward the first member. This aspect allows for excellent vibration isolation between the handle and motor housing.

In a third general aspect of the present invention is provided a power tool including a motor housing, a handle mounted to the motor housing having a pilot extending therefrom, and a vibration isolating seal positioned between the motor housing and the handle. The vibration isolating seal also includes an opening to operatively couple to the pilot.

In a fourth general aspect of the present invention is included a power tool including: a device for housing a motor, a device for holding the tool, and a device for rotationally connecting and pneumatically sealing the device for holding to the device for housing and for vibrationally isolating the device for holding from the device for housing. The above two aspects provide mechanisms by which the handle is rotatably connected and sealed to the motor housing while also being vibrationally isolated from the motor housing.

In a fifth aspect in accordance with the present invention is provided a power tool including: a housing, a handle, a vibration isolator operatively coupled between the housing and the handle, and a device for allowing sliding rotation of the handle relative to the vibration isolator. The vibration isolator and the device for allowing sliding rotation provide structure by which a power tool may have an adjustable handle while also vibrationally isolating the handle from the motor housing.

Lastly, in another general aspect of the present invention is furnished a pneumatic power tool comprising a handle, a housing having a longitudinal axis, and a vibration isolator rotatably coupling the handle to the housing, the vibration isolator including a central opening through which air passes, and wherein the central opening is in non-alignment with the longitudinal axis. This aspect provides a pneumatic tool with a vibration isolation but without the requirement that the isolator be located along the longitudinal axis of the housing.

The foregoing and other features and advantages of the present invention will be apparent from the following more particular description of the preferred embodiment of the invention.

BRIEF DESCRIPTION OF THE DRAWINGS

The preferred embodiments of this invention will be described in detail, with reference to the following figures, wherein like designations denote like elements, and wherein.

DETAILED DESCRIPTION OF THE PREFERRED EMBODIMENTS

Although certain preferred embodiments of the present invention will be shown and described in detail, it should be understood that various changes and modifications may be made without departing form the scope of the appended claims. The scope of the present invention will in no way be limited to the number of constituting components, the materials thereof, the shapes thereof, the relative arrangement thereof, etc., and are disclosed simply as an example of the preferred embodiment.

Figure 1:
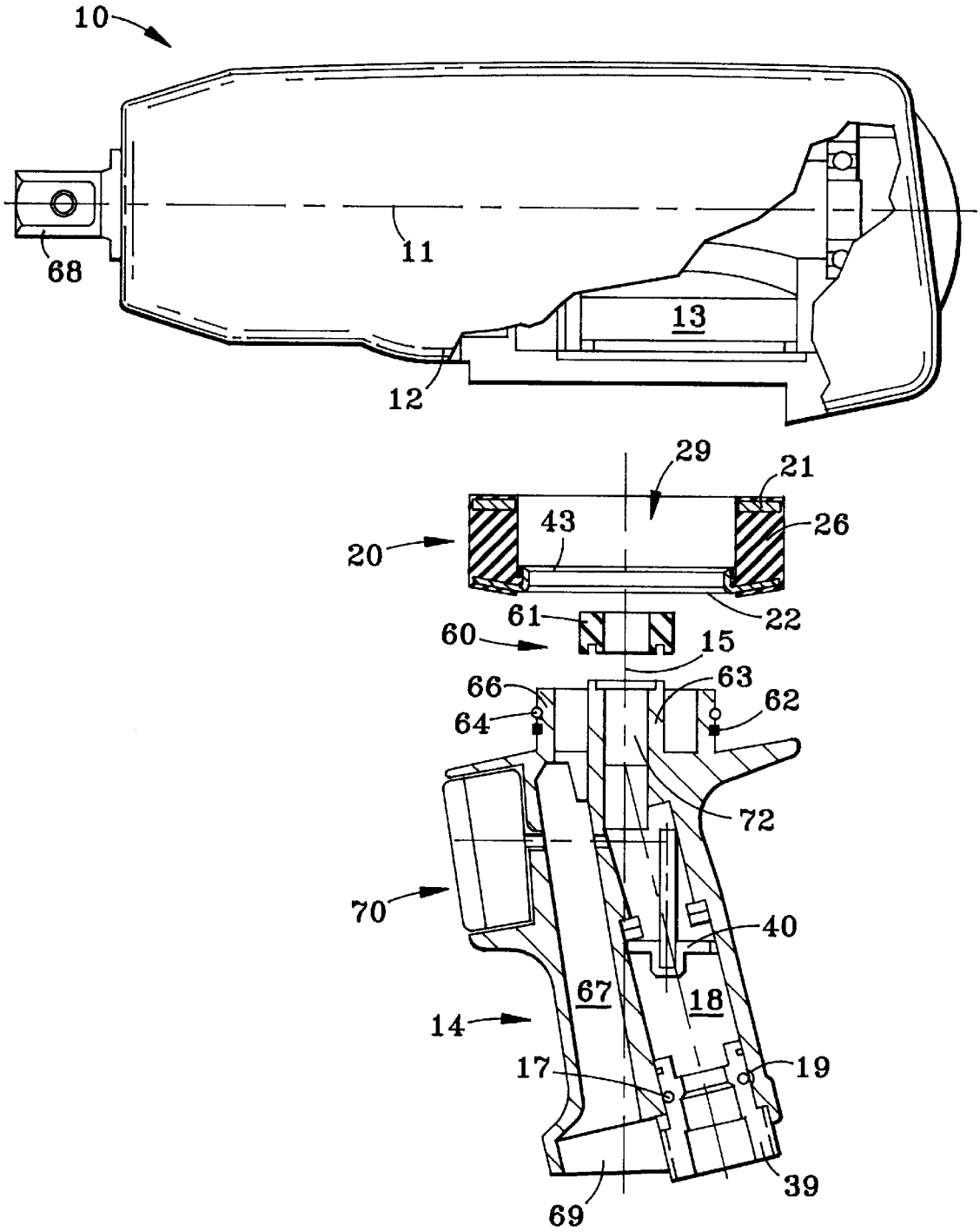
FIG. 1 is a side view of a power tool in accordance with a preferred embodiment of the present invention.

Referring now to the drawings and more particularly to FIG. 1, there is shown a side view of a hand-held power tool 10 with the handle 14 in the straight-ahead position. The power tool basically comprises a motor housing 12, a handle 14 and a coupling system, and more particularly a vibration isolator 20 that also acts as a seal. The motor housing 12 extends along a longitudinal axis 11 and comprises a tool attachment area 68 at the forward end of the axis 11, and a motor 13 at the rear end of the axis 11. The handle extends generally perpendicularly from the motor housing 12 and includes an inlet bushing 39 at a lower end to attach a source of compressed air (not shown) to the handle. The handle 14 also includes an air intake passage 18 that provides compressed air to the motor housing 12 and an exhaust passage 67 to exhaust expanded air from the motor housing 12.

The vibration isolator or vibration isolating seal 20 in accordance with the present invention is capable of the combined functions of coupling and sealing the motor housing 12 to the handle 14, and vibrationally isolating the handle 14 from the motor housing 12. As shown in FIGS. 2–5, the vibration isolator 20 generally includes a first rigid member or element 21 and a second rigid member or element 22 that are connected by an elastomeric member 26. The vibration isolator 20 also includes a central axis 15 and a central opening 29 through which air passes as will be described infra. The rigid members 21, 22 may be made from a variety of rigid materials such as steel, aluminum or alloys thereof. The elastomeric member or element 26 may be made from any elastomeric material, e.g., rubber or synthetic elastomer such as neoprene.

Figure 2:
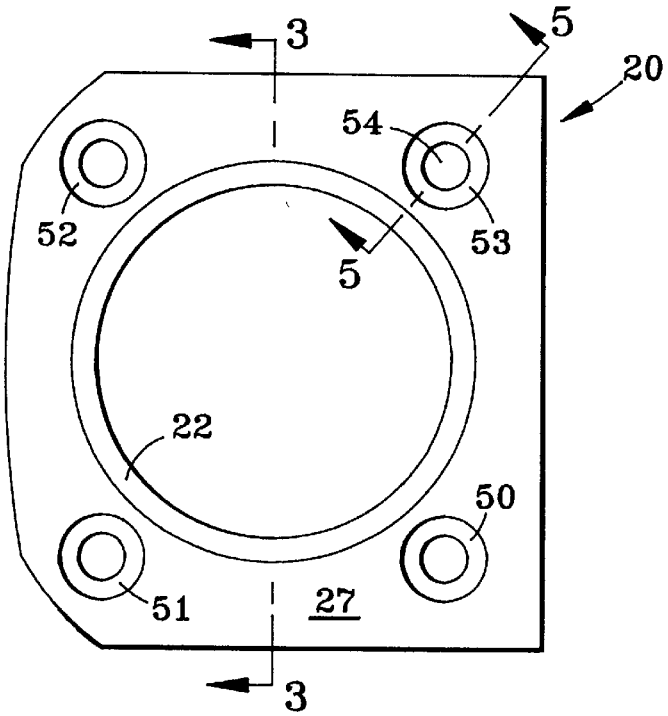
FIG. 2 is a plan view of a vibration isolator in accordance with a preferred embodiment of the present invention.
Figure 5:
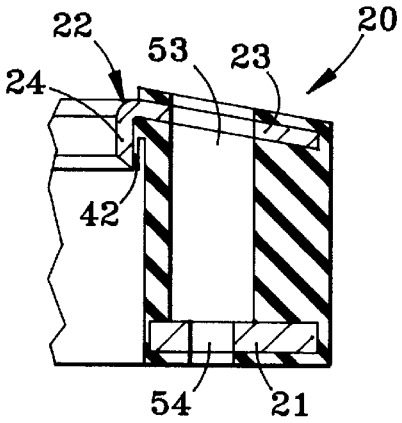
FIG. 5 is an exploded partial cross-sectional view of the vibration isolator in accordance with a preferred embodiment of the present invention.

As more particularly illustrated in FIGS. 2 and 5, the vibration isolator 20 includes a plurality of sets of apertures 50–53 for connection of the vibration isolator 20 to the motor housing 12. Each set of apertures 50–53 includes an aperture in the first member 21, the second member 22 and the elastomeric member 26. The apertures in each member are aligned for insertion of a fastener 58 (shown only in FIG. 7) therethrough and into the motor housing 12. The first member 21 has an aperture 54, as shown in FIG. 5, that is slightly smaller than the apertures through the elastomeric member 26 and second member 22 to receive the head of the fastener 58.

The second member 22 includes a first portion 23 and a second portion 24 which are bonded to the elastomeric member 26. The second portion 24 extends from an edge of the first portion 23 towards the first member 21. In a preferred embodiment of the present invention, the second portion 24 also includes a beveled edge 43, the function of which will be described infra.

Figure 3:
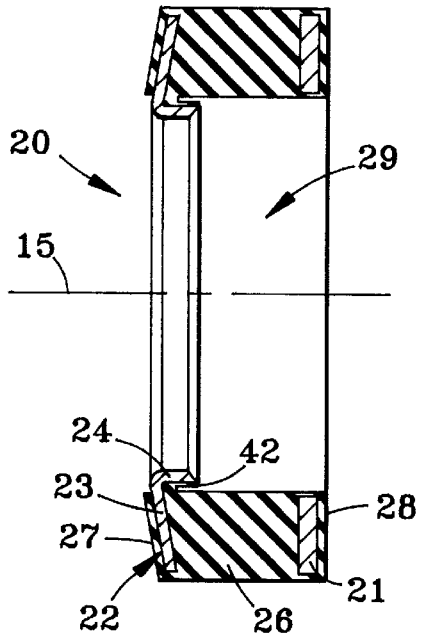
FIG. 3 is a cross-sectional view of the vibration isolator in accordance with a preferred embodiment of the present invention.
Figure 4:
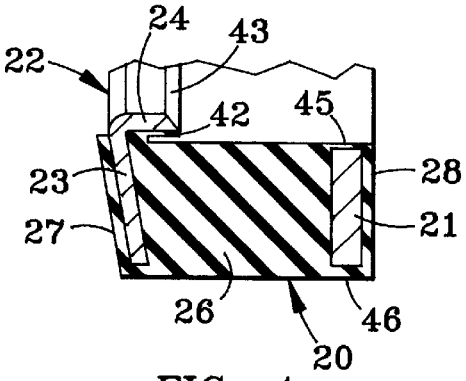
FIG. 4 is an exploded partial cross-sectional view of the vibration isolator in accordance with a preferred embodiment of the present invention.

In the preferred embodiment of the present invention, as shown in FIGS. 3–5, the elastomeric member 26 is formed so as to enclose at least a portion of the first and second members 21, 22 to aid in pneumatically sealing the handle 14 to the motor housing 12 so that compressed air and expanded air can be delivered to and from the motor housing 12, respectively. In particular, the elastomeric member 26 includes a covering portion 27 that extends around the first portion 23 of the second member 22 and a thin lip 42 that runs along an interior surface of the second portion 24 of the second member 22. Furthermore, the elastomeric member preferably encircles or covers the first member 21 in its entirety. More specifically, the elastomeric member 26 includes a pair of leaflets 45, 46 that extend over the edges of the first member 21, and a covering layer 28 that covers the remaining edge of the first member 21.

Figure 6:
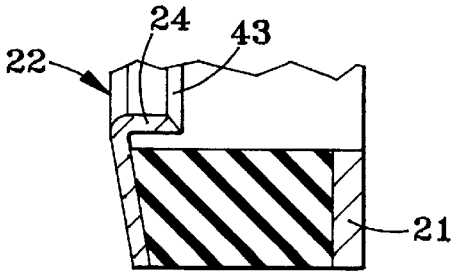
FIG. 6 is an exploded partial cross-sectional view of a vibration isolator in accordance with a second embodiment of the present invention.

It should be noted, however, that the first and second members need not be enclosed by the elastomeric member 26. As shown in FIG. 6, the members 21, 22 may merely be bonded to the elastomeric member 26. However, in this setting the members 21, 22 and the motor housing 12 must be more precisely machined so as to prevent leakage of compressed air and expanded air. Further, a gasket (not shown) may be required between member 21 and motor housing 12. For example, the gasket could be incorporated into member 21 or an O-ring type feature or lip could be provided on the elastomeric member 26.

Again referring to FIG. 1, the handle 14 is attached to the vibration isolator 20 by a flange or pilot 66. To connect the handle 14, the pilot 66 is inserted into the second portion 24 of the second member 22, which mates with the pilot 66. A clamp ring 64 is then inserted into the pilot 66 to prevent removal. Further, the pilot 66 includes an elastomeric o-ring 62 that seals the pilot 66 against the second portion 24 of the second member 22. The o-ring 62 can be made from any elastomeric material, for instance, rubber. To seal the air intake passages 18, 72 to the motor housing 12, an intake seal 61 is provided which seals an intake pilot or flange 63 on the handle 14 to the motor housing 12. The intake seal 61 can be made from any elastomeric material, e.g., rubber or synthetic elastomers such as neoprene. In combination, the seals 61 and 62 and flanges 63, 66 form a pair of concentric passages for intake and exhaust of air through the central opening 29 of the vibration isolator 20. As an alternative, it is also contemplated that the intake seal 61 could be incorporated into the elastomeric member 26.

In the preferred embodiment, the pilot 66 is cylindrical as is the first portion 24 of the second member 22. The clamp ring 64 is circular and is adapted to bear against the bevel 43 formed on the first portion 24 of the second member 22. This structure allows relatively frictionless sliding rotation of the handle 14 relative to the motor housing 12. As a result, the handle 14 can rotate about the central axis 15 independent of motor housing 12 to better accommodate the user's comfortable use of the tool 10.

The position to which the handle 14 is adjusted is preferably held by the back pressure of the elastomeric member 26 including covering layer 27, and the intake seal 61. The pressure, acting downwardly upon the handle 14, aids in pressing/holding the clamp ring 64 against bevel 43. It is also contemplated that a wavy spring (not shown) or similar structure be incorporated, for instance, along the top edge of the flange 66 for engagement with the motor housing 12 to position the handle 14. However, direct metal to metal structure is to be avoided as it would potentially short circuit, i.e., prevent proper operation of, the vibration isolator 20. Furthermore, if such structure were to be provided, the mechanism by which engagement with the motor housing 12 is created provide low friction in comparison to the torsional stiffness of the isolator 20 to avoid spring back of the handle 14 during adjustment.

In the preferred embodiment, the hand tool 10 is powered via compressed air. This is accomplished as follows. Air enters through inlet bushing 39 into intake passage 18, passes through the throttle valve 40, through passage 72, and to a reverse valve (not shown) in the motor housing 12. Air inlet bushing 39 may be secured to the tool handle 14 by means of a pin 17 and a groove 19. This permits the inlet to turn freely relative to the handle 14.

Air then passes to the motor housing and a valve system (not shown) in the motor housing 12, then through the motor 13 in a conventional fashion to operate in the power tool. Air can exhaust from the motor housing 12 through handle exhaust passage 67, then through diffuser 69, and into the atmosphere.

As shown in FIG. 1, the tool is depicted in its standard "straight-ahead" position. That is, the trigger 70 is pointed in the same direction as the tool attachment device 68 on the front of motor housing 12. This is the position that such tools are normally fixed for use. The tool attachment device 68 may comprise a square drive anvil, a chuck, or any other device which will allow for the attachment of sockets, wrenches, drill bits, or any other rotating attachment apparatus.

Figure 7:
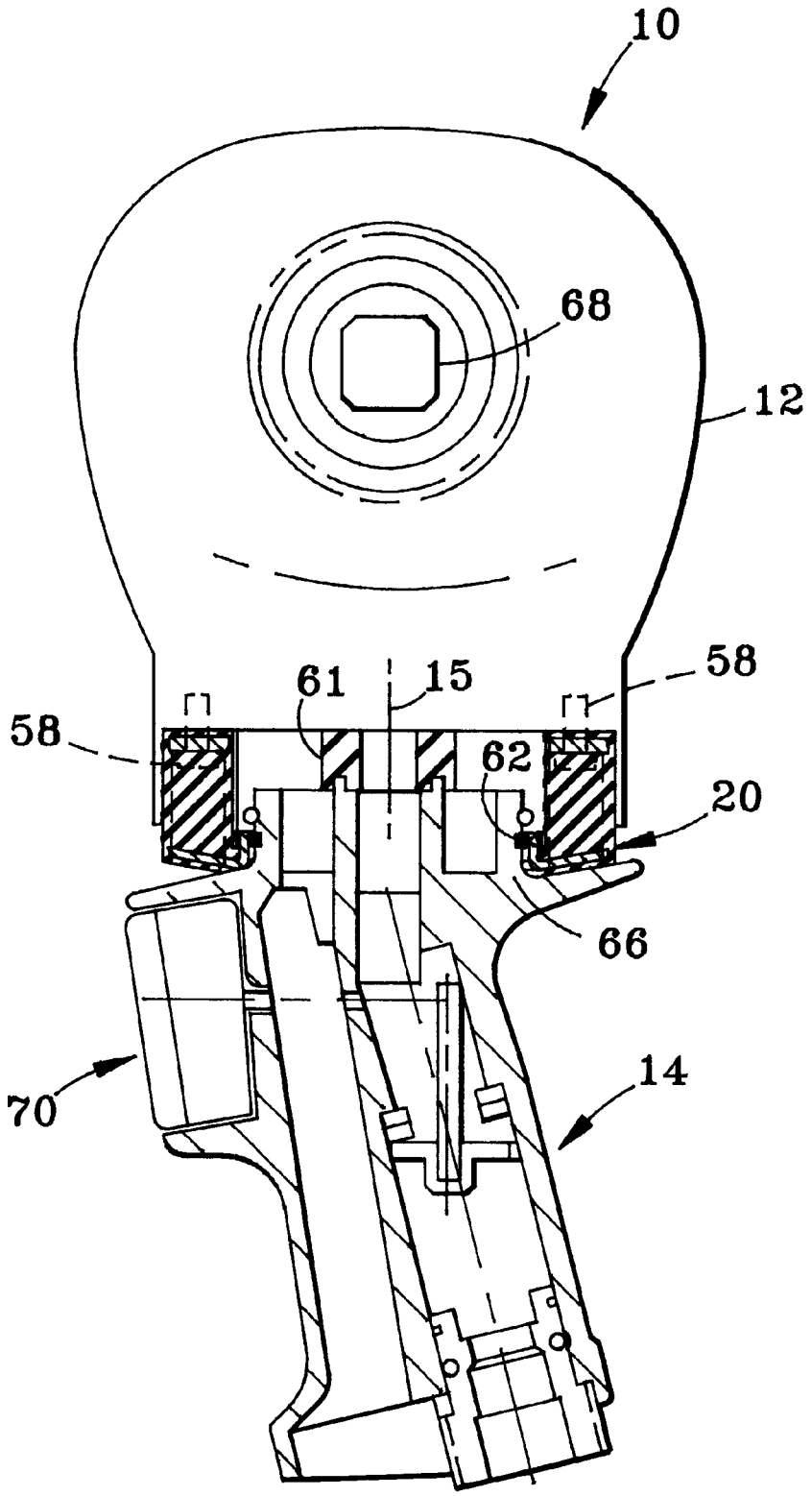
FIG. 7 is a partial cross-sectional view of a power tool in accordance with a preferred embodiment of the present invention.

It should be recognized, however, that there are a number of advantages created by having the vibration isolator 20 and handle 14 in non-alignment with the longitudinal axis 11 of the motor housing 12. The advantages are realized in that the present invention allows for many more comfortable settings for a user. For instance, FIG. 7 depicts the tool 10 with the handle 14 rotated 90° about the central axis 15 and shows the vibration isolator 20 and handle 14 connected to the motor housing 12. Handle 14 is shown (along with trigger 70) facing in a leftward direction, while motor housing 12 (along with tool attachment device 68) is shown facing the forward direction. Thus, as depicted in this diagram, handle 14 and the tool housing 12 can be set to face in different directions. In particular, the handle 14 is fully rotatable (i.e., 360°) about the central axis 15 which allows for an unlimited number of handle positions. This allows the user to adjust the tool to obtain the correct wrist/hand position for the variety of jobs he or she may be doing while also vibrationally isolating the handle 14 from the motor housing 12.

It should also be acknowledged, as shown in FIGS. 1 and 7, that the base of the handle 14 may be constructed such that it is cocked in a slightly backward position and such that it rotates about the central axis 15 of the vibration isolator 20 which is perpendicular to the longitudinal axis 11 of the motor housing 12. This particular construction allows for more freedom in adjustment to better accommodate a user's comfort. However, it is possible to incorporate a system wherein the positioning of the handle 14 is provided in a different way. For instance, the handle 14 could rotate about an axis that is not perpendicular to the motor housing 12. In particular, the position in which vibration isolator 20 connects to handle 14 could be constructed skewed, or angularly offset, to allow for a skewed connection of the vibration isolator 20 to the motor housing 12. Similarly, the vibration isolator 20 may be attached to the motor housing 12 at a skewed or angularly offset position.

In the preferred embodiment, the motor housing 12 and the handle 14 are depicted as co-planar. However, it is envisioned that a system could be utilized in which the motor housing 12 and the handle 14 were not co-planar. Because of the design of the air intake and exhaust systems, along with the vibration isolating seal 20, compressed air would still reach the motor housing 12 through the handle 14 and exhaust out of the handle while the handle 14 is in any rotated position.

As depicted in the drawings, the tool motor 13 is driven by compressed air. However, it is envisioned that the vibration isolating seal and rotatable handle system could be used for any fluid-driven power tool. Further, the rotatable handle system and vibration isolator could also be used on tools powered by other sources, e.g., electricity.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

We claim:

1. A vibration isolator for use on a power tool having a motor housing and a handle, the vibration isolator comprising:

a first member including at least one open passageway therethrough, and adapted to be coupled to the motor housing;

a second member including at least one open passageway therethrough, and adapted to be coupled to the handle;

an elastomeric member extending between the first member and second member, wherein the second member includes a first portion operatively coupled to the elastomeric member and a second portion extending toward the first member; and a seal operatively coupled to at least one of the first member and the second member.

2. The vibration isolator of claim 1, wherein the second portion is tubular and is adapted to be coupled to the handle by a substantially cylindrical flange extending from the handle, securable and sealable via a clamp and o-rings, such that the handle slidably rotates relative to the vibration isolator.

3. The vibrator isolator of claim 1, wherein the elastomeric member encircles the first member to aid in sealing the first member to the motor housing.

4. The vibration isolator of claim 1, wherein the first member includes at least one aperture extending therethrough; and wherein the first member is adapted to be coupled to the motor housing by a fastener extending through said at least one aperture.

5. The vibration isolator of claim 1, wherein the second member is adapted to be coupled to the handle having an inlet passage and an outlet passage extending therethrough; and wherein the vibration isolator further includes an opening for communication between the motor housing and inlet and outlet passages.

6. The vibration isolator of claim 5, wherein the second portion is adapted to be coupled to an intake seal to seal the inlet passage to the motor housing.

7. The vibration isolator of claim 6, wherein a passage is formed between the couplable intake seal and the opening in the vibration isolator.

8. The vibration isolator of claim 1, wherein the second member is adapted to be coupled to the handle having a throttle valve actuatable by a trigger device for the power tool.

9. The vibration isolator of claim 1, wherein the elastomeric member encircles the second member to aid in sealing the second member to the handle.

10. The vibration isolator of claim 1, further comprising a central opening through which air passes, and wherein the central opening is couplable in non-alignment with a longitudinal axis of the motor housing.

11. The vibration isolator of claim 1, wherein the seal is an O-ring adapted to be attached between one of the first member and the motor housing and the second member and the handle.

12. The vibration isolator of claim 1, wherein at least one of the first member and the second member are at least partially embedded within the elastomeric member to form a seal.

* * * * *